United States Patent [19]

Ozeki et al.

[11] 4,345,874

[45] Aug. 24, 1982

[54] EXHAUST FAN WITH PROTECTIVE BAND

[75] Inventors: Kenichi Ozeki, Ichinomiya; Takashi Fushimi, Mino, both of Japan

[73] Assignee: Tokyo Shibaura Denki Kabushiki Kaisha, Kawasaki, Japan

[21] Appl. No.: 124,901

[22] Filed: Feb. 26, 1980

[30] Foreign Application Priority Data

Jul. 24, 1979 [JP] Japan ..... 54-94070

[51] Int. Cl.[3] ..... F01D 29/70

[52] U.S. Cl. ..... 415/9; 415/219 R

[58] Field of Search ..... 415/219 R, 200, 9; 427/154, 155, 156; 126/299 C, 299 D, 299 E, 299 R

[56] References Cited

U.S. PATENT DOCUMENTS

| | | | |
|---|---|---|---|
| 1,792,514 | 2/1931 | Spear | 415/148 |
| 2,141,923 | 12/1938 | McMahan | 415/148 |
| 2,802,595 | 8/1957 | Veitch | 427/156 X |
| 3,620,796 | 11/1971 | Gordy | 427/156 X |
| 3,911,895 | 10/1975 | Van Schoyck | 126/299 D |

FOREIGN PATENT DOCUMENTS

| | | | |
|---|---|---|---|
| 45-1721 | 1/1970 | Japan | 427/156 |
| 763199 | 12/1956 | United Kingdom | 427/154 |

*Primary Examiner*—Leonard E. Smith

*Attorney, Agent, or Firm*—Cushman, Darby & Cushman

[57] ABSTRACT

An exhaust fan comprising rotatable fan blades, a motor for rotating the blades, a case for mounting and surrounding the blades, and a band detachably disposed and surrounding the case for permitting removal of a coating film from the case, the film being a coating for covering the case and the band for protecting the case from dirt, especially cooking grease.

16 Claims, 8 Drawing Figures

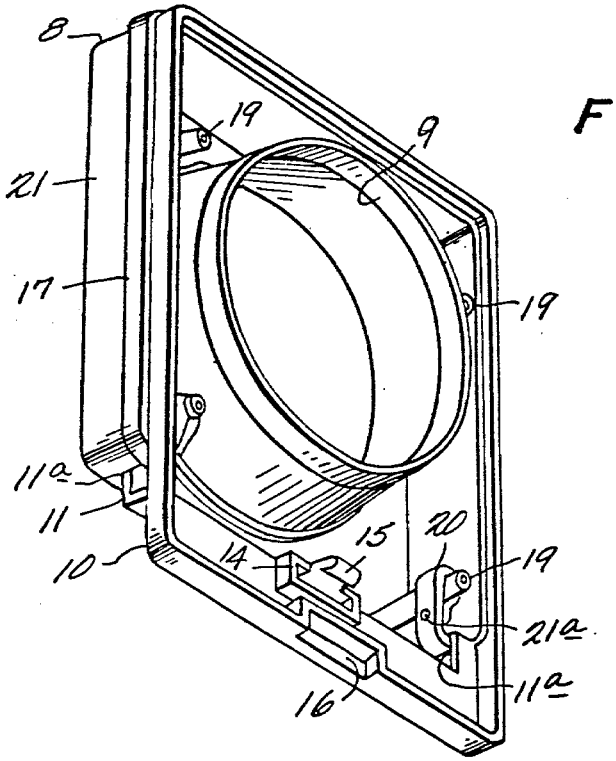
FIG. 4
FIG. 5
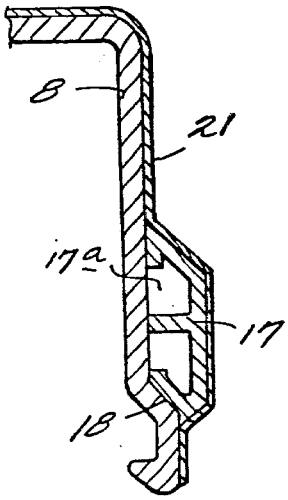
FIG. 6
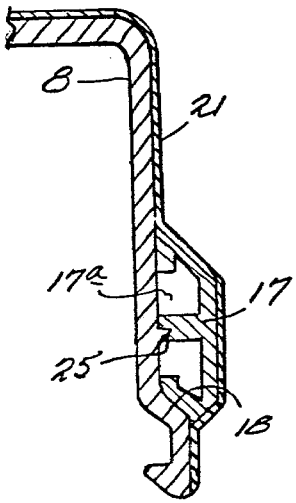
FIG. 7
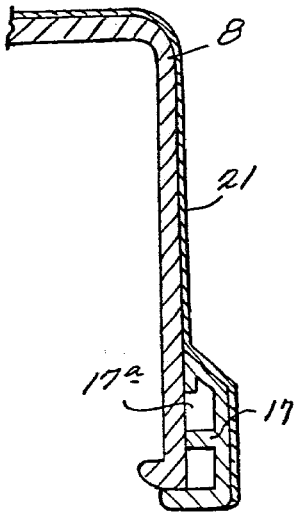

EXHAUST FAN WITH PROTECTIVE BAND

This invention relates to an exhaust fan and more particularly to an improvement in a band which is detachably disposed on the case of the fan for removing a protective coating film.

In an exhaust fan, for example, a ventilator for exhausting hot air from a kitchen, the surface of the case surrounding the fan blades is inevitably soiled by cooking grease. It is very difficult to clean grease from the surface of the case. Covering the surface of the case with a removable protective coating film solves this problem. The film protects the case from becoming greasy, but it is difficult to peel the film from the case in an unbroken sheet.

It is an object of this invention to provide an exhaust fan from which such film is easily removed.

It is another object of this invention to provide an exhaust fan which has a band surrounding a case for easy removal of the film.

This invention relates to an exhaust fan having rotatable blades, a drive motor for rotating the blades, a case for mounting and surrounding the blades, and a detachable band surrounding the case for easy removal of the protective film therewith.

FIG. 4 is a rear view of a case according to the first embodiment of this invention;

FIG. 5 is a fragmentary sectional view of a case and a band taken along line 5—5 of FIG. 3, in the direction of the arrows;

FIG. 6 is a fragmentary sectional view of a case and a band taken as in FIG. 5, but according to a second embodiment of this invention;

FIG. 7 is a fragmentary sectional view of a case and band taken as in FIG. 5, but according to a third embodiment of this invention.

Figure 1:
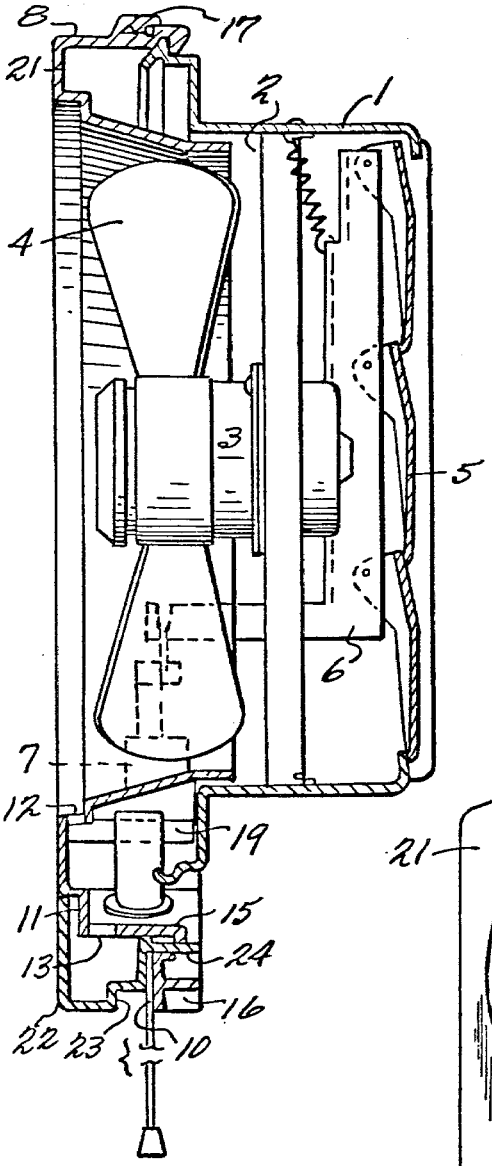
FIG. 1 is a sectional view of an exhaust fan according to the first embodiment of this invention.
Figure 2:
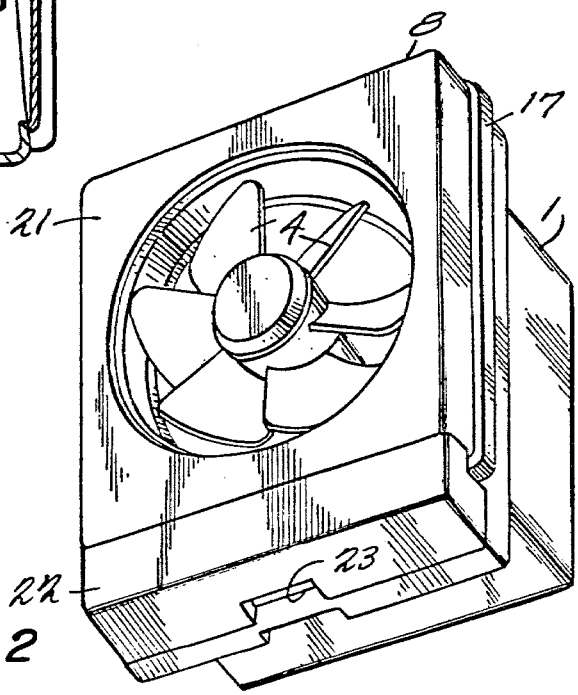
FIG. 2 is a perspective view of the exhaust fan according to the first embodiment of this invention.
Figure 3:
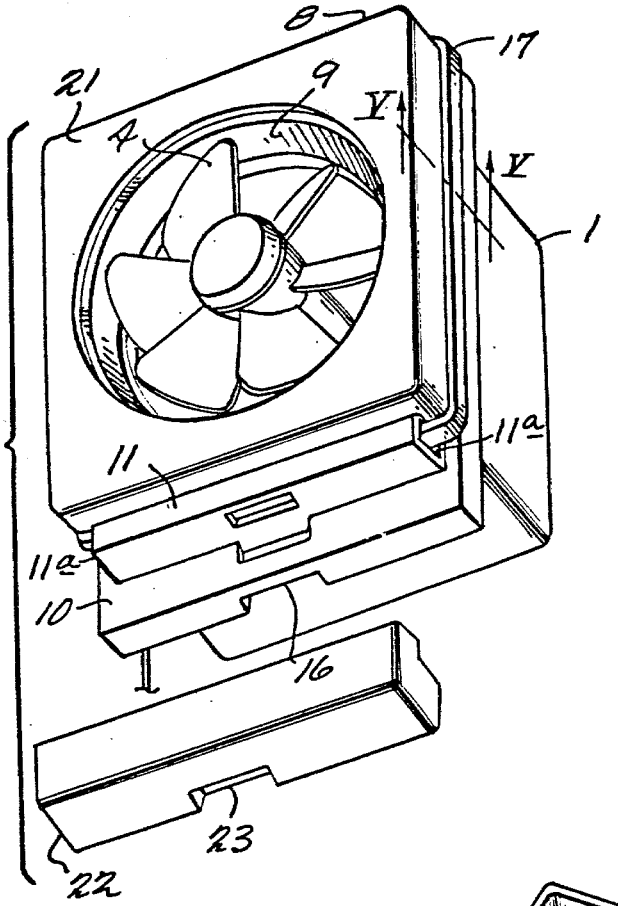
FIG. 3 is a partly exploded perspective view of the exhaust fan according to the first embodiment of this invention.

Now there will be described a first embodiment according to FIGS. 1–5 which show an exhaust fan for exhausting the hot air from a kitchen.

A frame 1 includes an arm 2 which supports a drive element, such as a motor 3. Fan blades 4 are rotatably mounted on a shaft (not shown) of motor 3. Therefore, air is exhausted by fan blades 4 from left to right in FIG. 1. A shutter 5 is movably mounted on a connecting lever 6. Energization and deenergization of motor 3 and opening and closing of shutter 5 are controlled by a switch 7 which is electrically connected to motor 3 and mechanically connected to shutter 5.

A case 8 is detachably mounted on the front opening of frame 1 and is made of synthetic resin, for example, polypropylene. Case 8 includes a bellmouth 9 which surrounds fan blades 4 and acts to collect the cooking grease. A flat surface 11 is formed on a skirt 10 of the lower portion of case 8. A grease draining hole 12 formed in the bottom of bellmouth 9 leads to grease draining hole 13 which is formed on the lower portion of surface 11 (see FIG. 3). An eyelet 14 covers almost all of the center portion of skirt 10 and a hook 15 is formed on the upper portion of eyelet 14. A recess 16 for receiving a band covers most of the center portion of the lower edge of case 8 (see FIG. 4).

Band 17 which surrounds the surface of case 8 and is provided on projection 18 of case 8 is made of silicon rubber. Band 17 is E-shaped (see FIG. 5) in cross-section with a central rib, so that band 17 touches the surface of case 8 in three places. A pair of spaces 17*a* are formed between the surface of case 8 and band 17. Each end of band 17 is passed through a hole 11*a* of surface 11 and form a ring 20 by means of rivets 20*a* and 21*a*, respectively. A bracket 19 is formed on the back of case 8 for supporting rings 20. Therefore, band 17 is removably attached to and surrounds the surface of case 8. A spray or a brush is used to coat the surface of case 8 and the surface of band 17 with a protective film 21. The film is made of a liquid synthetic resin which comprises 60% polyurethane resin, 38.5% solvent, including ethanol, osopropanol, isobutanol or acetic acid, 1.5% surfactant, traces of stabilizer, and traces of silicon. A grease collector 22 attaches to skirt 10 and has a recess 23 which is formed for hooking onto protrusion 24. Protrusion 24 extends through eyelet 14 and is connected to hook 15, so that grease collector 22 is attached to the lower portion of case 8 for covering the end of band 17 and making the surface level with the surface of case 8. Then, grease collector 22 receives the cooking grease as it drops from bellmouth 9 through grease draining holes 12 and 13.

In the foregoing first embodiment, film 21 is easily removed with band 17, so that the film is very easily stripped from case 8. Further, the synthetic film is easily removed from case 8 because the band has an E-shaped cross-section.

FIG. 6 shows a second embodiment of the case of this invention. In this embodiment, a projection 25 is formed on the surface of case 8 in the direction of band 17 for preventing slippage of band 17.

FIG. 7 shows a third embodiment of the band 17 and case 8 of this invention. In this embodiment, the surface of case 8 is flat and a part of band 17 is disposed to protrude from the edge of case 8 for convenience in removing film 21 and band 17 from case 8.

Figure 8:
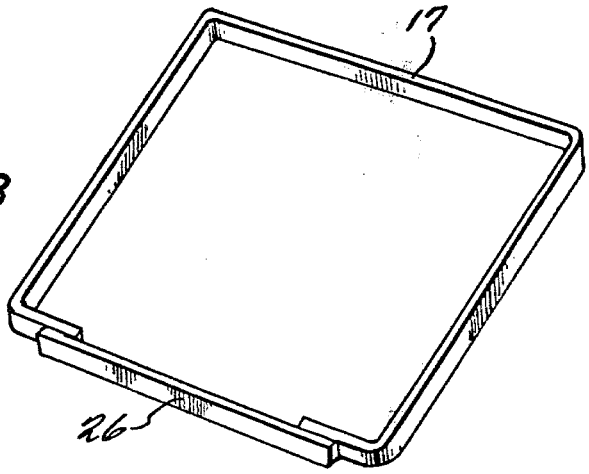
FIG. 8 is a perspective view of a band according to a fourth embodiment of this invention.

FIG. 8 shows a fourth embodiment of the band of this invention. In this embodiment, the ends of band 17 are connected with each other by a stretchable material, such as rubber 26. Band 17 thus wraps once around case 8.

Many changes and modifications from the above embodiments can be carried out without departing from the scope of the invention, that scope being limited only by the scope of the appended claims.

What is claimed is:

1. An exhaust fan comprising:

rotatable blades;

drive means for rotating said rotatable blades;

a case for mounting and surrounding at least said rotatable blades;

band means detachable disposed and surrounding said case so as to protrude therefrom for removing a coating film therewith, said film covering said case and said band means for protecting said case from dirt.

2. An exhaust fan comprising:

rotatable blades;

drive means for rotating said rotatable blades;

a case for mounting and surrounding at least said rotatable blades; and band means detachable disposed and surrounding said case for removing a coating film therewith, said film covering said case and said band means for protecting said case from dirt, said bands being connected with each other by a stretchable material.

3. An exhaust fan comprising:

rotatable blades;

drive means for rotating said rotatable blades;

a case for mounting and surrounding at least said rotatable blades;

band means detachable disposed and surrounding said case for removing a coating film therewith, said film covering said case and said band means for protecting said case from dirt, and a grease collector located in the lower part of said case for receiving grease and covering the ends of said band means.

4. An exhaust fan comprising:

rotatable blades;

drive means for rotating said rotatable blades;

a case for mounting and surrounding at least said rotatable blades; and band means detachably disposed and surrounding said case for removing a coating film therewith, said film covering said case and said band means for protecting said case from dirt, said case including two bosses for securing each end of said band means.

5. The exhaust fan as in claim 4 wherein said band means is so formed as to contact the surface of said case and to form a space between said surface of said case and a part of said band means.

6. An exhaust fan comprising:

rotatable blades;

drive means for rotating said rotatable blades;

a case for mounting and surrounding at least said rotatable blades;

band means detachably disposed in contact with and surrounding said case for removing a coating film therewith, said film covering said case and said band means for protecting said case from dirt, and said band means forming a space between said surface of said case and a part of said band means.

7. The exhaust fan as in claim 6, wherein said case includes means for securing the ends of said band means.

8. The exhaust fan as in claim 6, wherein said case includes a projection which is formed on the surface of said case for preventing slippage of said band means.

9. The exhaust fan as in claim 6, wherein the ends of said band means are connected with each other by a stretchable material.

10. The exhaust fan as in claim 6, a section of said band means being E-shaped.

11. The exhaust fan as in claim 6, 7, or 4 wherein said band means is disposed to protrude from the end of said case.

12. An exhaust fan comprising:

rotatable blades;

drive means for rotating said rotatable blades;

a case for mounting and surrounding at least said rotatable blades including a projection formed on a surface thereof;

band means detachably disposed and surrounding said case for removing a coating film therewith, said film covering said case and said band means for protecting said case from dirt, said band means engaging said projection to prevent slippage.

13. The exhaust fan as in claim 6, 7, 4, 8 or 12 wherein said band means is made of elastic material.

14. The exhaust fan as in claim 13, wherein said band means is made from rubber.

15. The exhaust fan as in claim 6, 7, 4, 12, 8, or 9 further comprising a grease collector which is located in the lower part of said case for receiving grease and covering the end of said band means.

16. The exhaust fan as in claim 6, 7, 4, 8, 12 or 9, wherein said case further comprises a bellmouth which is formed by surrounding said fan blades, and said exhaust fan is driven for exhausting the air from a room.

* * * * *